US009201328B2

(12) United States Patent
Sawamoto et al.

(10) Patent No.: US 9,201,328 B2
(45) Date of Patent: Dec. 1, 2015

(54) CORE MATERIAL FOR RESIN-FILLED FERRITE CARRIER AND FERRITE CARRIER FOR ELECTROPHOTOGRAPHIC DEVELOPER, AND ELECTROPHOTOGRAPHIC DEVELOPER USING THE FERRITE CARRIER

(71) Applicant: POWDERTECH CO., LTD., Chiba (JP)

(72) Inventors: Hiroki Sawamoto, Chiba (JP); Takao Sugiura, Chiba (JP)

(73) Assignee: POWDERTECH CO., LTD., Chiba (JP)

( * ) Notice: Subject to any disclaimer, the term of this patent is extended or adjusted under 35 U.S.C. 154(b) by 50 days.

(21) Appl. No.: 14/219,162

(22) Filed: Mar. 19, 2014

(65) Prior Publication Data

US 2014/0287355 A1 Sep. 25, 2014

(30) Foreign Application Priority Data

Mar. 21, 2013 (JP) ..... 2013-058778

(51) Int. Cl.

| | |
|---|---|
| ***G03G 9/00*** | (2006.01) |
| ***G03G 9/10*** | (2006.01) |
| ***G03G 9/113*** | (2006.01) |
| ***G03G 9/107*** | (2006.01) |

(52) U.S. Cl.

CPC ..... *G03G 9/10* (2013.01); *G03G 9/107* (2013.01); *G03G 9/1075* (2013.01); *G03G 9/113* (2013.01); *G03G 9/1132* (2013.01)

(58) Field of Classification Search

CPC ..... G03G 9/107; G03G 9/1075; G03G 9/113
USPC ..... 430/111.1, 111.35, 111.32
See application file for complete search history.

(56) References Cited

U.S. PATENT DOCUMENTS

| | | | |
|---|---|---|---|
| 2006/0269862 | A1 | 11/2006 | Kobayashi et al. |
| 2007/0048649 | A1 | 3/2007 | Kobayashi et al. |
| 2007/0231731 | A1 | 10/2007 | Suwa et al. |
| 2009/0176170 | A1 | 7/2009 | Sugiura et al. |
| 2009/0263739 | A1 | 10/2009 | Sugiura et al. |
| 2011/0013948 | A1 | 1/2011 | Aga et al. |
| 2011/0195357 | A1 | 8/2011 | Sugiura et al. |

FOREIGN PATENT DOCUMENTS

| | | |
|---|---|---|
| EP | 2 085 828 | 8/2009 |
| EP | 2 116 904 | 11/2009 |
| JP | 5-40367 | 2/1993 |
| JP | 2006-337579 | 12/2006 |
| JP | 2007-57943 | 3/2007 |
| JP | 2007-271663 | 10/2007 |
| JP | 2008-310104 | 12/2008 |
| JP | 2009-175666 | 8/2009 |
| JP | 2009-244572 | 10/2009 |
| JP | 2009-244837 | 10/2009 |

OTHER PUBLICATIONS

Search report from E.P.O., mail date is Jul. 11, 2014.

*Primary Examiner* — Mark A Chapman
(74) *Attorney, Agent, or Firm* — Greenblum & Bernstein, P.L.C.

(57) ABSTRACT

Disclosed are a resin-filled ferrite carrier core material for an electrophotographic developer, including a porous ferrite particle having an average compression strength of 100 mN or more and a coefficient of variation of the compression strength of 50% or less, a ferrite carrier obtained by filling a resin in the voids of the ferrite carrier core material, and an electrophotographic developer using the ferrite carrier.

9 Claims, No Drawings

CORE MATERIAL FOR RESIN-FILLED FERRITE CARRIER AND FERRITE CARRIER FOR ELECTROPHOTOGRAPHIC DEVELOPER, AND ELECTROPHOTOGRAPHIC DEVELOPER USING THE FERRITE CARRIER

BACKGROUND OF THE INVENTION

1. Field of the Invention

The present invention relates to a resin-filled ferrite carrier core material and a ferrite carrier for an electrophotographic developer, being used in apparatuses such as copiers and printers, being excellent in durability because of having a light true density and a high carrier strength, and causing no charge variation at the time of endurance printing, and an electrophotographic developer using the ferrite carrier.

2. Description of the Related Art

An electrophotographic development method is a method in which development is performed by adhering the toner particles in a developer to the electrostatic latent image formed on a photoreceptor, and the developer used in such a method is classified into a two-component developer composed of toner particles and carrier particles and a one-component developer using only toner particles.

As a development method using, among such developers, a two-component developer composed of toner particles and carrier particles, previously a method such as a cascade method has been adopted, but currently a magnetic brush method using a magnet roll predominates.

In a two-component developer, the carrier particles serve as a carrying substance to form a toner image on the photoreceptor in such a way that the carrier particles are stirred together with the toner particles in a developer box filled with the developer to impart an intended charge to the toner particles, and further, convey the thus charged toner particles to the surface of the photoreceptor to form the toner image on the photoreceptor. The carrier particles remaining on a development roll which holds a magnet again return from the development roll into the developer box to be mixed and stirred with the fresh toner particles and to be repeatedly used for a predetermined period of time.

In contrast to a one-component developer, a two-component developer is such that the carrier particles are mixed and stirred with the toner particles, thus charge the toner particles, and further have a function to convey the toner particles, and a two-component developer is excellent in the controllability in designing developers. Accordingly, two-component developers are suitable for full-color development apparatuses required to offer high image quality and for high speed printing apparatuses required to be satisfactory in the reliability and durability in image maintenance.

In two-component developers used in the above-described manner, the image properties such as the image density, fogging, white spots, gradation and resolution are each required to exhibit a predetermined value from the initial stage, and further these properties are required to be invariant and to be stably maintained during the endurance printing. For the purpose of stably maintaining these properties, the properties of the carrier particles contained in the two-component developers are required to be stable.

As the carrier particles forming two-component developers, there have hitherto been used various carriers such as iron powder carriers, ferrite carriers, resin coated ferrite carriers and magnetic powder-dispersed resin carriers.

Recently office networking has been promoted, and the age of monofunctional copiers develops into the age of multifunctional copiers; the service system has also shifted from the age of the system such that a contracted service man conducts periodic maintenance inclusive of the replacement of the developer to the age of the maintenance-free system; thus, the market has further enhanced demand for further longer operating life of the developer.

Under such circumstances, for the purpose of reducing the carrier particle weight and extending the developer operating life, there have been also proposed a variety of magnetic powder-dispersed carriers in each of which magnetic fine particles are dispersed in a resin in Japanese Patent Laid-Open No. 5-40367 etc.

Such magnetic powder-dispersed carriers can be reduced in true density by decreasing the amounts of the magnetic fine particles and can be reduced in stress caused by stirring, and hence can be prevented from the abrasion and exfoliation of the coating film and accordingly can offer stable image properties over a long period of time.

However, the magnetic powder-dispersed carrier is prepared by agglomerating magnetic fine particles with a binder resin, and hence offers, as the case may be, a problem that the magnetic fine particles are detached due to the stirring stress or the impact in the developing device or a problem that the carrier particles themselves are cracked probably because the magnetic powder-dispersed carriers are inferior in mechanical strength to the iron powder carriers and ferrite carriers having hitherto been used. The detached magnetic fine particles and the cracked carrier particles adhere to the photoreceptor to cause image defects as the case may be.

Additionally, the magnetic powder-dispersed carrier uses magnetic fine particles, and accordingly has a drawback that the residual magnetization and the coercive force are high and the fluidity of the developer is degraded. In particular, when a magnetic brush is formed on a magnet roll, the presence of the high residual magnetization and the high coercive force hardens the ears of the magnetic brush and hence high image quality is hardly obtained. Also, even when the magnetic powder-dispersed carrier is separated away from the magnet roll, the magnetic coagulation of the carrier is not unstiffened and the mixing of the carrier with the supplied toner is not rapidly conducted, and hence there occurs a problem that the charge amount rise is aggravated, and image defects such as toner scattering and fogging are caused.

In addition to such magnetic powder-dispersed carriers, for the reduction of the weight of the carrier particle, there have been proposed hollow carriers in which a vacancy is formed in the interior of the carrier core material particle. For example, Japanese Patent Laid-Open No. 2008-310104 states that a core particle has at least a vacancy of 20% or more and 65% or less in terms of the cross sectional area, and the overall vacancy proportion in terms of the cross sectional area is 20% or more and 70% or less. Japanese Patent Laid-Open No. 2009-244572 states that when the outer diameter of the carrier core material is represented by $d_1$ and the outer diameter of the vacancy present in the interior of the core material is represented by $d_2$, the relation $0.1<d_2/d_1<0.9$ is preferably satisfied.

In the carriers described in these patent documents, the weight reduction is certainly attained; however, in any of these carriers, the size of one vacancy is extremely large, and hence, as compared to conventional ferrite carriers having no hollow portion, these carriers are still weak in mechanical strength, thus the fracture of the carrier particles occurs due to the stirring stress or the impact in the developing device at the time of endurance printing, and the fractured particles adhere to the photoreceptor to offer a cause for the occurrence of image defects. Accordingly, for the extension of the operating life having been recently, particularly demanded, these carriers are absolutely unsatisfactory.

Further, as the substitutes for such magnetic powder-dispersed carriers and hollow carriers, resin-filled ferrite carriers obtained by filling a resin in the voids of ferrite carrier core materials using porous ferrite particles have been proposed.

Japanese Patent Laid-Open No. 2006-337579 proposes a resin-filled ferrite carrier prepared by filling a resin in a ferrite carrier core material having a porosity of 10 to 600, and Japanese Patent Laid-Open No. 2007-57943 proposes a resin-filled ferrite carrier having a three-dimensional laminated structure. Further, Japanese Patent Laid-Open Nos. 2009-175666 and 2009-244837 each specify the pore volume, the pore size and the pore size distribution property of the ferrite carrier core material including porous ferrite particles to be filled with a resin, and propose a resin-filled ferrite carrier which has a high insulation breakdown voltage and is improved in the fracture strength of the carrier particle, and a resin-filled ferrite carrier which is fast in the charge rise property and causes no charge variation, respectively.

In each of the resin-filled ferrite carriers described in these patent documents, a resin is filled even in the interior of the porous ferrite particles to form a three-dimensional laminated structure. In particular, in Japanese Patent Laid-Open Nos. 2009-175666 and 2009-244837, the pore size distribution property is controlled more accurately, and hence the variation of the resin filling degree is reduced, and further, it is stated that the surface of the filling resin is preferably coated with a resin. Consequently, indeed the weight reduction of the carrier particle is attained, and the carrier strength is improved to a certain degree; however, these carriers are far from having a sufficient carrier strength. Accordingly, in particular, for the high durability having been recently demanded, these carriers are far from being satisfactory.

On the other hand, Japanese Patent Laid-Open No. 2007-271663 describes a ferrite carrier for an electrophotographic developer having a compression fracture strength of 150 MPa or more and a compression variation rate of 15.0% or more, and states that the carrier is excellent in the strength against the fracture due to stress when used as a developer.

However, the ferrite carrier (ferrite particles) used in Japanese Patent Laid-Open No. 2007-271663 is not porous, and is not a resin-filled ferrite carrier using porous ferrite particles, and hence it is impossible to obtain an advantage of a resin-filled ferrite carrier, such as the weight reduction.

Therefore, with respect to the demand for high durability, there has been demanded a resin-filled ferrite carrier for an electrophotographic developer in which, while the weight reduction is being achieved, the improvement of the carrier strength is achieved, and the charging property is stabilized at the time of endurance printing.

SUMMARY OF THE INVENTION

Accordingly, an object of the present invention is to provide a resin-filled ferrite carrier core material and a ferrite carrier for an electrophotographic developer, in which, while the advantages of the resin-filled ferrite carrier are being maintained, the durability is improved by imparting a high carrier strength, and the charging property is stabilized at the time of endurance printing, and an electrophotographic developer using the ferrite carrier.

For the purpose of solving the above-described problems, the present inventors conducted a diligent study, and consequently have reached the present invention by finding that it is possible to obtain a porous ferrite particle having a high compression strength and a coefficient of variation of the compression strength, equal to or smaller than a certain value, by exactly controlling the calcination conditions, the pulverization conditions and the sintering conditions at the time of production of the ferrite carrier core material (a porous ferrite particle), and by discovering that it is possible to obtain a ferrite carrier having a high strength by filling a resin into the porous ferrite particle.

Specifically, the present invention provides a resin-filled ferrite carrier core material for an electrophotographic developer, including a porous ferrite particle having an average compression strength of 100 mN or more and a coefficient of variation of the compression strength of 500 or less.

In the resin-filled ferrite carrier core material for an electrophotographic developer according to the present invention, preferably the pore volume and the peak pore size of the porous ferrite particle are 0.04 to 0.10 ml/g and 0.3 to 1.5 μm, respectively, and the pore size variation dv represented by the following formula in the pore size distribution of the porous ferrite particle is 1.5 or less:

$$dv=|d_{84}-d_{16}|/2 \quad (1)$$

$d_{16}$: Pore size calculated from the pressure applied to mercury when the amount of the intruded mercury reaches 16% in relation to the total amount of the intruded mercury in the high pressure region, defined as 100%

$d_{84}$: Pore size calculated from the pressure applied to mercury when the amount of the intruded mercury reaches 84% in relation to the total amount of the intruded mercury in the high pressure region, defined as 100%

The present invention also provides a resin-filled ferrite carrier for an electrophotographic developer, wherein a resin is filled in the voids of the ferrite carrier core material, and 3 to 20 parts by weight of the resin is filled in relation to 100 parts by weight of the ferrite carrier core material.

In the resin-filled ferrite carrier for an electrophotographic developer according to the present invention, the surface of the ferrite carrier is preferably coated with a resin.

In the resin-filled ferrite carrier for an electrophotographic developer according to the present invention, preferably the volume average particle size thereof is 20 to 50 μm, the saturation magnetization thereof is 30 to 80 $Am^2/kg$ and the apparent density thereof is 1.0 to 2.2 $g/cm^3$.

Additionally, the present invention provides an electrophotographic developer including the resin-filled ferrite carrier and a toner.

The electrophotographic developer according to the present invention is a refill developer.

The ferrite carrier obtained by filling a resin in the resin-filled ferrite carrier core material for an electrophotographic developer according to the present invention is low in specific gravity and is allowed to achieve weight reduction, hence is excellent in durability and is allowed to attain long operating lives, and moreover, is higher in strength as compared to the magnetic powder-dispersed carrier and is free from the occurrence of the cracking, deformation and melting due to heat or impact. The ferrite carrier has a high carrier strength, and hence is improved in durability and has a stable charging property at the time of endurance printing.

DETAILED DESCRIPTION OF THE EMBODIMENTS

Hereinafter, the best mode for carrying out the present invention is described.

<Resin-Filled Ferrite Carrier Core Material for Electrophotographic Developer and Ferrite Carrier According to Present Invention>

The resin-filled ferrite carrier core material for an electrophotographic developer according to the present invention includes a porous ferrite particle, and the average compression strength of the porous ferrite particle is 100 mN or more, preferably 100 to 250 mN and more preferably 120 to 250 mN. In the case where the average compression strength is less than 100 mN, when the ferrite carrier core material is filled with a resin and used as a ferrite carrier, no high carrier strength is obtained and the ferrite carrier is poor in durability. The porous ferrite particle as referred to in the present invention means an aggregate of the individual porous ferrite particles, unless otherwise specified, and a simple term of a particle means a single porous ferrite particle.

The coefficient of variation of the compression strength of the porous ferrite particle, which is the resin-filled ferrite carrier core material for an electrophotographic developer according to the present invention, is 500 or less, preferably 40% or less and more preferably 35% or less. When the coefficient of variation of the compression strength exceeds 50%, the variation of the compression strength becomes too large, and even when the average compression strength falls within an intended range, the presence probability of weak particles is increased, no high carrier strength is obtained and the durability is poor.

[Average Compression Strength and Coefficient of Variation of Compression Strength]

The Nanoindentation Hardness Tester ENT-1100a manufactured by Elionix Co., Ltd. was used. A glass plate on which the porous ferrite particles were dispersed was set in the tester, and measured in an environment set at 25° C. For the test, a flat indenter having a diameter of 50 μmϕ was used, and the ferrite particles were loaded to 490 mN at a loading rate of 49 mN/s.

In the selection of the particle, used were the porous ferrite particles of the case where only one particle was found in a measurement screen (width 130 μm×height 100 μm) of the Nanoindentation Hardness Tester, having a spherical shape, and having an average value of the major axis and the minor axis, as measured by the software appended to ENT-1100a, falling in a range of the carrier volume average particle size±2 μm. When the slope of the load-displacement curve approached to 0, the particle was determined as fractured, and the load corresponding to the inflection point was taken as the compression strength. The compression strength values of the 100 particles were measured, the 10 maximum values and the 10 minimum values were deleted, the remaining 80 values were adopted as the data, and the average compression strength was obtained from the data.

The standard deviation was derived for the above-described 80 values, and the coefficient of variation of the compression strength was determined from the following formula.

$$\text{Coefficient of variation of compression strength (\%)} = (\text{standard deviation}/\text{average compression strength}) \times 100$$

The pore volume and the peak pore size of the porous ferrite particle, the resin-filled ferrite carrier core material for an electrophotographic developer according to the present invention, are preferably 0.04 to 0.10 ml/g and 0.3 to 1.5 μm, respectively.

When the pore volume of the porous ferrite particle is less than 0.04 ml/g, no sufficient amount of a resin can be filled in and hence no weight reduction can be achieved. When the pore volume of the porous ferrite particle exceeds 0.10 ml/g, even the filling of the resin cannot maintain the strength of the carrier. The range of the pore volume of the porous ferrite particle is preferably from 0.05 to 0.10 ml/g and more preferably from 0.06 to 0.08 ml/g.

When the peak pore size of the porous ferrite particle is 0.3 μm or more, the asperity size of the surface of the core material is of an appropriate size, hence the contact area with the toner is increased, the triboelectric charging with the toner is performed efficiently, and consequently the charge rise property is improved in spite of the low specific gravity. When the peak pore size of the porous ferrite particle is less than 0.3 μm, such an advantageous effect is not obtained and the carrier surface after filling becomes flat and smooth, and hence, no sufficient stress with the toner is given to the carrier that is low in specific gravity to degrade the charge rise. When the peak pore size of the porous ferrite particle exceeds 1.5 μm, the resin-dwelling area of the particles becomes large in relation to the surface area of the particles, and accordingly the aggregation between the particles tends to occur at the time of the resin filling and large proportions of aggregated particles and irregularly shaped particles are found in the carrier particles having been filled with the resin. Consequently, the stress in endurance printing disintegrates the aggregated particles to offer a cause for the charge variation. Such a porous ferrite particles that have a peak pore size exceeding 1.5 μm means that the asperities of the particle surface are large; this means that the particles themselves are poor in shape and also poor in strength, and consequently the stress due to endurance printing causes the cracking of the carrier particles themselves to offer a cause for the charge variation. The range of the peak pore size of the porous ferrite particle is more preferably 0.4 to 1.2 μm and most preferably 0.4 to 0.8 μm.

As described above, the pore volume and the peak pore size designed to fall within the above-described ranges enable to obtain a resin-filled ferrite carrier that is free from the above-described problems and is appropriately reduced in weight.

[Pore Size and Pore Volume of Porous Ferrite Particle]

The measurements of the pore size and the pore volume of the porous ferrite particle are performed as follows. Specifically, the measurement is performed with the mercury porosimeters, Pascal 140 and Pascal 240 (manufactured by Thermo Fisher Scientific Inc.). A dilatometer CD3P (for powder) is used, and a sample is put in a commercially available gelatin capsule with a plurality of bored holes and the capsule is placed in the dilatometer. After deaeration with Pascal 140, mercury is charged and a measurement in the low pressure region (0 to 400 kPa) is performed as a first run. Successively, the deaeration and another measurement in the low pressure region (0 to 400 kPa) are performed as a second run. After the second run, the total weight of the dilatometer, the mercury, the capsule and the sample is measured. Next, a high pressure region (0.1 MPa to 200 MPa) measurement is performed with Pascal 240. On the basis of the amount of the intruded mercury obtained by the measurement in the high pressure region, the pore volume, the pore size distribution and the peak pore size of the porous ferrite particle were determined. When the pore size is obtained, the calculation is performed under the conditions that the surface tension and the contact angle of mercury are 480 dyn/cm and 141.3°, respectively.

In the pore size distribution of the porous ferrite particle, the variation dv of the pore size is preferably 1.5 or less. Here, the total amount of the intruded mercury in the high pressure region is defined as 100%, the pore size calculated from the pressure applied to the mercury when the intrusion amount reaches 84% is denoted by $d_{84}$, and the pore size calculated from the pressure applied to the mercury when the intrusion amount reaches 16% is denoted by $d_{16}$. The dv value is calculated from the following formula (1).

$$dv=|d_{84}-d_{16}|/2 \quad (1)$$

When the variation of the pore size of the porous ferrite particle, dv, exceeds 1.5 means that the variations of the asperities and the core material shape among particles come to be large. Accordingly, when the dv value exceeds the intended range, the variations among the particles tend to occur with respect to the charge rise, the charge variation and the aggregation due to the particle shape or the resin filling.

The composition of the porous ferrite particle preferably includes at least one selected from Mn, Mg, Li, Ca, Sr, Cu and Zn. In consideration of the recent trend of the environmental load reduction including the waste regulation, it is preferable not to include the heavy metals, Cu, Zn and Ni each in a content exceeding an inevitable impurity (associated impurity) range.

The resin-filled ferrite carrier for an electrophotographic developer according to the present invention is obtained by filling a resin into the voids of the resin-filled ferrite carrier core material including the foregoing porous ferrite particle. The resin filling amount is preferably 3 to 20 parts by weight, more preferably 4 to 15 parts by weight and furthermore preferably 5 to 12 parts by weight in relation to 100 parts by weight of the ferrite carrier core material. When the resin filling amount is less than 3 parts by weight, an insufficiently filled ferrite carrier is obtained, and it comes to be difficult to control the charge amount by resin coating. When the resin filling amount exceeds 20 parts by weight, aggregated particles tend to occur at the time of filling, to offer a cause for charge variation.

The filling resin is not particularly limited, and can be appropriately selected according to the toner to be combined therewith, the use environment and the like. Examples of the filling resin include: fluororesins, acrylic resins, epoxy resins, polyamide resins, polyamideimide resins, polyester resins, unsaturated polyester resins, urea resins, melamine resins, alkyd resins, phenolic resins, fluoroacrylic resins, acryl-styrene resins and silicone resins; and modified silicone resins obtained by modification with a resin such as an acrylic resin, a polyester resin, an epoxy resin, a polyamide resin, a polyamideimide resin, an alkyd resin, a urethane resin or a fluororesin. A thermosetting resin is preferably used in consideration of the detachment of the resin due to the mechanical stress in use. Specific examples of the thermosetting resin include: epoxy resins, phenolic resins, silicone resins, unsaturated polyester resins, urea resins, melamine resins and alkyd resins; and resins including these resins.

For the purpose of controlling the electric resistance, the charge amount and the charging rate of the carrier, a conductive agent can be added in the filling resin. The electric resistance of the conductive agent itself is low, and hence when the addition amount of the conductive agent is too large, a rapid charge leakage tends to occur. Accordingly, the addition amount of the conductive agent is 0.25 to 20.0% by weight, preferably 0.5 to 15.0% by weight and particularly preferably 1.0 to 10.0% by weight in relation to the solid content of the filling resin. Examples of the conductive agent include conductive carbon, oxides such as titanium oxide and tin oxide, and various organic conductive agents.

Additionally, a charge control agent can be added in the filling resin. Examples of the charge control agent include various types of charge control agents generally used for toners and various types of silane coupling agents. This is because in a case where a large amount of a resin is filled, the charge imparting ability is degraded as the case may be, but the addition of various types of charge control agents and silane coupling agents enables the control of the degradation of the charge imparting ability. The usable types of the charge control agents and the silane coupling agents are not particularly limited; preferable examples of the usable charge control agents and silane coupling agents include: charge control agents such as nigrosine dyes, quaternary ammonium salts, organometallic complexes and metal-containing monoazo dyes; and aminosilane coupling agents and fluorosilane coupling agents.

In the resin-filled ferrite carrier for an electrophotographic developer according to the present invention, the surface thereof is preferably coated with a coating resin. The carrier properties, in particular, the electric properties including the charging property are frequently affected by the materials present on the carrier surface and by the properties and conditions of the carrier surface. Accordingly, by coating the surface of the carrier with an appropriate resin, intended carrier properties can be regulated with a satisfactory accuracy.

The coating resin is not particularly limited. Examples of the coating resin include: fluororesins, acrylic resins, epoxy resins, polyamide resins, polyamideimide resins, polyester resins, unsaturated polyester resins, urea resins, melamine resins, alkyd resins, phenolic resins, fluoroacrylic resins, acryl-styrene resins and silicone resins; and modified silicone resins obtained by modification with a resin such as an acrylic resin, a polyester resin, an epoxy resin, a polyamide resin, a polyamideimide resin, an alkyd resin, a urethane resin or a fluororesin. A thermosetting resin is preferably used in consideration of the detachment of the resin due to the mechanical stress in use. Specific examples of the thermosetting resin include: epoxy resins, phenolic resins, silicone resins, unsaturated polyester resins, urea resins, melamine resins and alkyd resins; and resins including these resins. The coating amount of the resin is preferably 0.5 to 5.0 parts by weight in relation to 100 parts by weight of the resin-filled carrier (before resin coating).

These coating resins may also contain conductive agents and charge control agents, for the same purposes as described above. The types and the addition amounts of the conductive agents and the charge control agents are the same as in the above-described cases of the filling resin.

The volume average particle size ($D_{50}$) of the resin-filled ferrite carrier for an electrophotographic developer according to the present invention is preferably 20 to 50 μm, and with this range, the carrier beads carry over is prevented and satisfactory image quality is obtained. When the volume average particle size is less than 20 μm, unpreferably such a particle size offers a cause for the carrier beads carry over. When the volume average particle size exceeds 50 μm, unpreferably such a particle size offers a cause for the image quality degradation due to the degradation of the charge imparting ability.

[Volume Average Particle Size (Microtrac)]

The volume average particle size is measured as follows. Specifically, the volume average particle size is measured with the Microtrac Particle Size Analyzer (model 9320-X100) manufactured by Nikkiso Co., Ltd. Water is used as a dispersion medium. In a 100-ml beaker, 10 g of a sample and 80 ml of water are placed, and a few drops of a dispersant (sodium hexametaphosphate) are added in the beaker. Next, the resulting mixture was subjected to dispersion for 20 seconds with an ultrasonic homogenizer (model UH-150, manufactured by SMT Co., Ltd.) set at an output power level of 4. Thereafter, the foam formed on the surface of the dispersed mixture in the beaker was removed and the dispersed mixture in the beaker was placed as a sample in the measurement apparatus.

The saturation magnetization of the resin-filled ferrite carrier for an electrophotographic developer according to the present invention is preferably 30 to 80 $Am^2/kg$. Unpreferably the saturation magnetization less than 30 $Am^2/kg$ offers the cause for the carrier beads carry over, and the saturation magnetization exceeding 80 $Am^2/kg$ makes the magnetic brush ears hard and thus makes it difficult to obtain satisfactory image quality.

[Saturation Magnetization]

The magnetization is measured with an integral-type B-H tracer, model BHU-60 (manufactured by Riken Denshi Co., Ltd.). An H coil for measuring magnetic field and a 4πI coil for measuring magnetization are inserted between the electromagnet pole pieces. In this case, a sample is placed in the 4πI coil. By integrating each of the outputs from the H coil and the 4πI coil while the magnetic field H is being varied by varying the current of the electromagnet, a hysteresis loop is depicted on a sheet of recording paper with the H output on the X-axis and the 4πI coil output on the Y-axis. Here, the measurement is performed under the following measurement conditions: the sample filling quantity: about 1 g; the sample filling cell: inner diameter: 7 mmϕ±0.02 mm and height: 10 mm±0.1 mm; 4πI coil: 30 turns.

The strength of the resin-filled ferrite carrier for an electrophotographic developer according to the present invention is preferably 3% or less and more preferably 1.5% or less. When the strength of the carrier exceeds 3%, the carrier strength is weak, and hence the cracking due to the impact with time occurs, and the charge variation with time is promoted.

[Carrier Strength]

In a 50-cc glass bottle, 20 g of a ferrite carrier was placed, and the glass bottle was set in a paint shaker to be shaken, and thus the ferrite carrier was stirred for 30 hours. When the stress due to the stirring causes the occurrence of the cracking and abrasion of the particles and the occurrence of fine particles, the average particle size of the ferrite carrier after the stirring becomes smaller. The weaker the strength of the ferrite carrier, the more probably the abrasion of the ferrite carrier occurs and the more probably fine particles of the ferrite carrier occur and the smaller the average particle size of the ferrite becomes. Accordingly, the variation rate of the average particle size before and after the stirring is adopted as the index of the carrier strength. The average particle size is the volume average particle size measured by using the foregoing Microtrac Particle Size Analyzer (Model 9320-X100) manufactured by Nikkiso Co., Ltd., and the variation rate of the particle size and the evaluation standard of the strength are as follows:

$$\text{Carrier strength (particle size variation rate)}\ (\%) = [(D_0 - D_1)/D_0] \times 100$$

$D_0$: Volume average particle size before stirring $D_1$: Volume average particle size after stirring The charge amount variation rate of the resin-filled ferrite carrier for an electrophotographic developer according to the present invention is preferably 80% or more and more preferably 85% or more. When the charge amount variation rate is less than 80%, a charge variation with time occurs, the image defects such as toner scattering, fogging and carrier beads carry over are promoted, and satisfactory image quality cannot be stably maintained.

(Charge Amount Variation Rate)

The charge amount was obtained from the measurement of a mixture composed of a carrier and a toner with a suction-type charge amount measurement apparatus (Epping q/m-meter, manufactured by PES-Laboratorium). The toner used was a commercially available negatively polar toner (cyan toner for use in DocuPrintC3530, manufactured by Fuji Xerox Co., Ltd., average particle size: about 5.8 μm) used in a full-color printer, and the developer amount was regulated to be 10 g and the toner concentration was regulated to be 10% by weight. The thus prepared developer was placed in a 50-cc glass bottle, the glass bottle was housed and fixed in a cylindrical holder of 130 mm in diameter and 200 mm in height; thus, the developer was stirred for 30 minutes with a Turbula mixer manufactured by Shinmaru Enterprises Corp., and the charge amount was measured by using a 635M screen.

The same commercially available negatively polar toner (cyan toner for use in DocuPrintC3530, manufactured by Fuji Xerox Co., Ltd., average particle size: about 5.8 μm) as described above was used, and the amount of the developer was regulated to be 20 g and the toner concentration was regulated to be 10% by weight; the thus prepared developer was placed in a 50-cc glass bottle, the glass bottle was placed in a paint shaker manufactured by Asada Iron Works Co., Ltd., and the developer was stirred for 30 hours. After completion of the stirring, the developer was take out, the toner was sucked by using a 635M screen, and thus only the carrier was taken out. The charge amount of the obtained carrier was measured by the above-described charge amount measurement method and the obtained charge amount was defined as the charge amount after the forced stirring.

Then, the charge amount variation rate was derived from the following formula:

$$\text{Charge amount variation rate}\ (\%) = \frac{\text{(Charge amount of carrier subjected to forced stirring)}}{\text{(Charge amount of carrier not subjected to forced stirring)}} \times 100$$

The apparent density of the resin-filled ferrite carrier for an electrophotographic developer according to the present invention is preferably 1.0 to 2.2 $g/cm^3$. When the apparent density is less than 1.0 $g/cm^3$, the carrier is too light in weight and hence the charge imparting ability tends to be degraded. When the apparent density exceeds 2.2 $g/cm^3$, the weight reduction of the carrier is insufficient and the carrier is poor in durability.

(Apparent Density)

The measurement of the apparent density is performed according to JIS-Z2504 (Test Method for Apparent Density of Metal Powders).

<Production Methods of Resin-Filled Ferrite Carrier Core Material and Ferrite Carrier for Electrophotographic Developer According to the Present Invention>

The production methods of the resin-filled ferrite carrier core material and the ferrite carrier for an electrophotographic developer according to the present invention are described.

For the purpose of producing a porous ferrite particle used as the resin-filled ferrite carrier core material for an electrophotographic developer according to the present invention, first, raw materials are weighed out in appropriate amounts, and then pulverized and mixed with a ball mill, a vibration mill or the like for 0.5 hour or more, preferably, 1 to 20 hours. The raw materials are not particularly limited.

The resulting pulverized mixture is converted into a pellet with a compression molding machine or the like, and then the pellet is calcined at a temperature of 700 to 1200° C.

After the calcination, further pulverization is conducted with a ball mill, a vibration mill or the like, thereafter water is added, and fine milling is performed with a bead mill or the like. Next, where necessary, a dispersant, a binder and the like are added, the viscosity is adjusted, and then granules are prepared by granulation with a spray dryer. In the pulverization after the calcination, pulverization may also be conducted by adding water with a wet ball mill, a wet vibration mill or the like.

The above-described pulverizing machine such as the ball mill, the vibration mill or the bead mill is not particularly limited; however, for the purpose of effectively and uniformly dispersing the raw materials, it is preferable to adopt fine beads having a particle size of 1 mm or less as the media to be used. By regulating the size and the composition of the beads used and the pulverization time, the degree of pulverization can be controlled.

Next, the granulated substance thus obtained was heated at 400 to 800° C., to remove the organic components such as the added dispersant or binder. If the sintering is conducted with the remaining dispersant or binder, the oxygen concentration in the sintering apparatus tends to be varied due to the decomposition or the oxidation of the organic components, magnetic properties are affected to a large degree, and hence it is difficult to stably perform the production. These organic components offer the causes for varying the control of the porous property, namely, the causes for varying the crystal growth of the ferrite.

Then, the granulated substance thus obtained is maintained for sintering at a temperature of 800 to 1500° C. for 1 to 24 hours in an oxygen concentration-controlled atmosphere. In this case, a rotary electric furnace, a batch electric furnace, a continuous electric furnace or the like is used, and the atmosphere at the time of sintering may be controlled with respect to the oxygen concentration by introducing an inert gas such as nitrogen or a reducing gas such as hydrogen or carbon monoxide.

The resulting sintered substance is pulverized and classified. As the classification method, the existing methods such as an air classification method, a mesh filtration method and a precipitation method are used to regulate the particle size to an intended particle size.

Then, where necessary, by applying low temperature heating to the surface, an oxide film forming treatment is performed and thus electric resistance can be regulated. In the oxide film forming treatment, a common rotary electric furnace, a common batch electric furnace or the like is used to allow the heat treatment to be performed, for example, at 300 to 700° C. The thickness of the oxide film formed by this treatment is preferably 0.1 nm to 5 μl. When the thickness is less than 0.1 nm, the effect of the oxide film layer is small, and when the thickness exceeds 5 μm, the magnetization is decreased or the resistance becomes too high, and thus unpreferably intended properties are hardly obtained. Where necessary, reduction may be performed before the oxide film forming treatment. In this way, a porous ferrite particle (ferrite core material) is prepared which has an average compression strength equal to or higher than a certain value and a coefficient of variation of the compression strength equal to or lower than a certain value.

For the purpose of allowing the average compression strength of the porous ferrite particle to be equal to or higher than a certain value and allowing the coefficient of variation of the compression strength of the porous ferrite particle to be equal to or lower than a certain value, it is necessary to strictly control the calcination conditions, the pulverization conditions and the sintering conditions. Specifically, the higher the calcination temperature, the more preferable. When the ferritization of the raw material is allowed to proceed at the stage of the calcination, the distortion occurring in the particle at the stage of the sintering can be reduced. With respect to the pulverization conditions, the longer the pulverization time, the more preferable. By reducing the particle size of the slurry, the external stress exerting on the inside of the porous ferrite particle comes to be uniformly dispersed. With respect to the sintering conditions, the longer the sintering time, the more preferable. When the sintering time is short, the sintered substance undergoes unevenness, and various properties inclusive of the compression strength undergo variations.

A resin is filled in the voids of the ferrite carrier core material consist of the porous particle thus obtained. As the filling method, various methods are available. Examples of the filling method include: a dry method, a spray drying method based on a fluidized bed, a rotary drying method and a dip-and-dry method using a universal stirrer or the like. The resins to be used herein are as described above.

In the step of filling the resin, it is preferable to fill the resin in the pores of the porous ferrite particles while the porous ferrite particles and the filling resin are being mixed under stirring under reduced pressure. Such filling of the resin under reduced pressure enables to efficiently fill the resin in the pores. The degree of the pressure reduction is preferably such that the pressure falls in a range from 10 to 700 mmHg. When the pressure exceeds 700 mmHg, no effect of the pressure reduction is attained, and when the pressure is less than 10 mmHg, the resin solution tends to boil during the filling step so as to inhibit efficient filling.

The resin-filling step can be performed as a plurality of divided steps. However, it is also possible to fill the resin in one resin-filling step. Thus, it is not necessary to dare to divide the filling step into a plurality of steps. However, depending on the type of the resin, an attempt to fill a large amount of the resin at a time leads to the occurrence of the aggregation of particles as the case may be. In the case where such aggregation occurs, when the carrier is used in a developing device, such aggregation of particles undergoes disintegration due to the stirring stress in the developing device as the case may be. The interface in the aggregated particles is largely different in the charging property, and hence unpreferably the charge variation occurs during passage of time. In such a case, the filling step divided into a plurality of steps enables to perform the filling in a just enough manner while the aggregation is being prevented.

After the filling of the resin, where necessary, heating is performed with various methods, so as to make the filled resin adhere to the core material. The heating method may be either an external heating method or an internal heating method; for example, a fixed electric furnace, a fluid-type electric furnace, a rotary electric furnace or a burner furnace may be used, or baking with microwave may also be adopted. The heating temperature is varied depending on the filing resin; the heating temperature is required to be a temperature equal to or higher than the melting point or the glass transition point; when a thermosetting resin, a condensation-crosslinking resin or the like is used, by increasing the heating temperature to a temperature allowing the curing to sufficiently proceed, a resin-filled carrier that has resistance against impact can be obtained.

After the resin has been filled in the porous ferrite particle as described above, the surface of the porous ferrite particle is preferably coated with a resin. The carrier properties, in particular, the electric properties including the charging property are frequently affected by the materials present on the carrier surface and by the properties and conditions of the carrier surface. Accordingly, by coating the surface of the porous ferrite particle with an appropriate resin, intended carrier properties can be regulated with a satisfactory accuracy. As the method for coating, heretofore known methods such as a brush coating method, a dry method, a spray drying method based on a fluidized bed, a rotary drying method and a dip-and-dry method using a universal stirrer can be applied for coating. The method based on a fluidized bed is preferable to improve the coverage factor. When baking is performed after the resin coating, either an external heating method or an internal heating method may be used; for example, a fixed electric furnace, a fluid-type electric furnace, a rotary electric furnace or a burner furnace may be used, or baking with microwave may also be adopted. When a UV curable resin is used, a UV heater is used. The baking temperature is varied depending on the resin used; the baking temperature is required to be a temperature equal to or higher than the melting point or the glass transition point; when a thermosetting resin, a condensation-crosslinking resin or the like is used, the baking temperature is required to be increased to a temperature allowing the curing to proceed sufficiently.

<Electrophotographic Developer According to the Present Invention>

Next, the electrophotographic developer according to the present invention is described.

The electrophotographic developer according to the present invention is composed of the above-described resin-filled ferrite carrier for an electrophotographic developer and a toner.

Examples of the toner particle that constitutes the electrophotographic developer of the present invention include a pulverized toner particle produced by a pulverization method and a polymerized toner particle produced by a polymerization method. In the present invention, the toner particle obtained by either of these methods can be used.

The pulverized toner particle can be obtained, for example, by means of a method in which a binder resin, a charge controlling agent and a colorant are fully mixed with a mixing machine such as a Henschel mixer, then the resulting mixture is melt-kneaded with an apparatus such as a double screw extruder, and the melt-kneaded mixture is cooled, pulverized and classified; an external additive is added to the resulting classified particle, and then the resulting mixture is mixed with a mixing machine such as a mixer to yield the pulverized toner particle.

The binder resin that constitutes the pulverized toner particle is not particularly limited. However, examples of the binder resin may include polystyrene, chloropolystyrene, styrene-chlorostyrene copolymer, styrene-acrylate copolymer and styrene-methacrylic acid copolymer, and further, rosin-modified maleic acid resin, epoxy resin, polyester resin and polyurethane resin. These binder resins are used each alone or as mixtures thereof.

As the charge controlling agent, any charge controlling agent can be used. Examples of the charge controlling agent for use in positively charged toners may include nigrosine dyes and quaternary ammonium salts. Additionally, examples of the charge controlling agent for use in negatively charged toners may include metal-containing monoazo dyes.

As the colorant (coloring material), hitherto known dyes and pigments can be used. Examples of the usable colorant include carbon black, phthalocyanine blue, permanent red, chrome yellow and phthalocyanine green. Additionally, for the purpose of improving the fluidity and the anti-aggregation property of the toner, external additives such as a silica powder and titania can be added to the toner particle according to the toner particle.

The polymerized toner particle is a toner particle produced by heretofore known methods such as a suspension polymerization method, an emulsion polymerization method, an emulsion aggregation method, an ester extension polymerization method and a phase inversion emulsion method. Such a polymerized toner particle can be obtained, for example, as follows: a colorant dispersion liquid in which a colorant is dispersed in water with a surfactant, a polymerizable monomer, a surfactant and a polymerization initiator are mixed in a aqueous medium under stirring to disperse the polymerizable monomer by emulsification in the aqueous medium; the polymerizable monomer thus dispersed is polymerized under stirring for mixing; thereafter, the polymer particles are salted out by adding a salting-out agent; the particles obtained by salting-out are filtered off, rinsed and dried, and thus the polymerized toner particle can be obtained. Thereafter, where necessary, an external additive is added to the dried toner particle.

Further, when the polymerized toner particle is produced, in addition to the polymerizable monomer, the surfactant, the polymerization initiator and the colorant, a fixability improving agent and a charge controlling agent can also be mixed; the various properties of the obtained polymerized toner particle can be controlled and improved by these agents. Additionally, a chain transfer agent can also be used for the purpose of improving the dispersibility of the polymerizable monomer in the aqueous medium and regulating the molecular weight of the obtained polymer.

The polymerizable monomer used in the production of the polymerized toner particle is not particularly limited. However, example of such a polymerizable monomer may include: styrene and the derivatives thereof; ethylenically unsaturated monoolefins such as ethylene and propylene; vinyl halides such as vinyl chloride; vinyl esters such as vinyl acetate; and α-methylene aliphatic monocarboxylic acid esters such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used when the polymerized toner particle is prepared, hitherto known dyes and pigments can be used. Examples of the usable colorant include carbon black, phthalocyanine blue, permanent red, chrome yellow and phthalocyanine green. Additionally, the surface of each of these colorants may be modified by using a silane coupling agent, a titanium coupling agent or the like.

As the surfactant used in the production of the polymerized toner particle, anionic surfactants, cationic surfactants, amphoteric surfactants and nonionic surfactants can be used.

Here, examples of the anionic surfactants may include: fatty acid salts such as sodium oleate and castor oil; alkyl sulfates such as sodium lauryl sulfate and ammonium lauryl sulfate; alkylbenzenesulfonates such as sodium dodecylbenzenesulfonate; alkylnaphthalenesulfonates; alkylphosphoric acid ester salts; naphthalenesulfonic acid-formalin condensate; and polyoxyethylene alkyl sulfuric acid ester salts. Additionally, examples of the nonionic surfactants may include: polyoxyethylene alkyl ethers, polyoxyethylene fatty acid esters, sorbitan fatty acid esters, polyoxyethylene alkylamines, glycerin, fatty acid esters and oxyethylene-oxypropylene block polymer. Further, examples of the cationic surfactants may include: alkylamine salts such as laurylamine acetate; and quaternary ammonium salts such as lauryltrimethylammonium chloride and stearyltrimethylammonium chloride. Additionally, examples of the amphoteric surfactants may include aminocarboxylic acid salts and alkylamino acids.

The above-described surfactants can each be used usually in a range from 0.01 to 10% by weight in relation to the polymerizable monomer. The used amount of such a surfactant affects the dispersion stability of the monomer, and also affects the environment dependence of the obtained polymerized toner particle, and hence such a surfactant is preferably used within the above-described range in which the dispersion stability of the monomer is ensured and the environment dependence of the polymerized toner particle is hardly excessively affected.

For the production of the polymerized toner particle, usually a polymerization initiator is used. Examples of the polymerization initiator include water-soluble polymerization initiators and oil-soluble polymerization initiators. In the present invention, either of a water-soluble polymerization initiator and an oil-soluble polymerization initiator can be used. Examples of the water-soluble polymerization initiator usable in the present invention may include: persulfates such as potassium persulfate and ammonium persulfate; and water-soluble peroxide compounds. Additionally, examples of the oil-soluble polymerization initiator usable in the present invention may include: azo compounds such as azobisisobutyronitrile; and oil-soluble peroxide compounds.

Additionally, for a case where a chain transfer agent is used in the present invention, examples of the chain transfer agent may include: mercaptans such as octylmercaptan, dodecylmercaptan and tert-dodecylmercaptan; and carbon tetrabromide.

Further, for a case where the polymerized toner particle used in the present invention contains a fixability improving agent, examples of the usable fixability improving agent include: natural waxes such as carnauba wax; and olefin waxes such as polypropylene wax and polyethylene wax.

Additionally, for a case where the polymerized toner particle used in the present invention contains a charge controlling agent, the charge controlling agent used is not particularly limited, and examples of the usable charge controlling agent include nigrosine dyes, quaternary ammonium salts, organometallic complexes and metal-containing monoazo dyes.

Additionally, examples of the external additives used for improving the fluidity and the like of the polymerized toner particle may include silica, titanium oxide, barium titanate, fluororesin fine particles and acrylic resin fine particles. These external additives can be used each alone or in combinations thereof.

Further, examples of the salting-out agent used for separation of the polymerized particles from the aqueous medium may include metal salts such as magnesium sulfate, aluminum sulfate, barium chloride, magnesium chloride, calcium chloride and sodium chloride.

The average particle size of the toner particle produced as described above falls in a range from 2 to 15 μm and preferably in a range from 3 to 10 μm, and the polymerized toner particle is higher in the particle uniformity than the pulverized toner particle. When the average particle size of the toner particle is less than 2 μm, the charging ability is degraded to tend to cause fogging or toner scattering; when larger than 15 μm, such a particle size offers a cause for image quality degradation.

Mixing of the carrier and the toner produced as described above can yield an electrophotographic developer. The mixing ratio between the carrier and the toner, namely, the toner concentration is preferably set at 3 to 15% by weight. When the toner concentration is less than 3% by weight, it is difficult to attain an intended image density; when larger than 15% by weight, toner scattering or fogging tends to occur.

The developer obtained by mixing the carrier produced as described above and a toner can be used as a refill developer. In this case, the mixing is performed in a mixing ratio between the carrier and the toner of 1 part by weight of the carrier to 2 to 50 parts by weight of the toner.

The electrophotographic developer according to the present invention, prepared as described above, can be used in a digital image formation apparatus, such as a copying machine, a printer, a FAX machine or a printing machine, adopting a development method in which an electrostatic latent image formed on a latent image holder having an organic photoconductor layer is reversely developed, while applying a bias electric field, with a magnetic brush of a two-component developer having a toner and a carrier. Additionally, the electrophotographic developer according to the present invention is also applicable to an image formation apparatus, such as a full-color machine, which adopts a method applying an alternating electric field composed of a DC bias and an AC bias superposed on the DC bias when a development bias is applied from the magnetic brush to the electrostatic latent image.

Hereinafter, the present invention is specifically described on the basis of Examples and others.

Example 1

Raw materials were weighed out so as to give the following composition: MnO: 38 mol %, MgO: 11 mol %, $Fe_2O_3$: 50.3 mol % and SrO: 0.7 mol %. The weighed out raw materials were pulverized with a dry media mill (vibration mill, stainless steel beads of ⅛ inch in diameter) for 4.5 hours, and the pulverized substance thus obtained was converted into about 1-mm cube pellets with a roller compactor. As the raw materials for MnO, MgO and SrO, trimanganese tetraoxide, magnesium hydroxide and strontium carbonate were used, respectively. The pellets were subjected to removal of coarse powder with a vibration sieve of 3 mm in mesh opening size, and then subjected to removal of fine powder with a vibration sieve of 0.5 mm in mesh opening size. Then, the pellets were heated for calcination at 1080° C. for 3 hours with a rotary electric furnace.

Next, the pellets were pulverized to an average particle size of about 4 μm with a dry media mill (vibration mill, stainless steel beads of ⅛ inch in diameter). Then, water was added to the pulverized pellets, and the mixture thus obtained was further pulverized for 10 hours with a wet media mill (upright bead mill, stainless steel beads of 1/16 inch in diameter). The particle size (primary particle size in pulverization) of the slurry thus obtained was measured with a Microtrac analyzer, and the $D_{50}$ was found to be 1.5 μm. An appropriate amount of a dispersant was added to the slurry, and for the purpose of obtaining an appropriate pore volume, PVA (20% solution) as a binder was added to the slurry in an amount of 0.2% by weight in relation to the solid content of the slurry. Then, the resulting slurry was granulated and dried with a spray dryer. The obtained particles (granulated substance) were regulated in particle size, and then heated at 700° C. for 2 hours with a rotary electric furnace to remove the organic components such as the dispersant and the binder.

Then, the thus treated particles were maintained at a sintering temperature of 1071° C. for 5 hours in an atmosphere of an oxygen gas concentration of 1.1% by volume with a tunnel electric furnace. In this case, the temperature increase rate was set at 150° C./hr and the temperature decrease rate was set at 110° C./hr. Subsequently, the sintered product was disintegrated and further classified to regulate the particle size, and subjected to separation and removal of low magnetic fractions with magnetic separation to yield a ferrite carrier core material consist of a porous ferrite particle.

To 25 parts by weight (the concentration of the resin solution was 20%, and hence the solid content was 5 parts by weight) of a methylsilicone resin solution, titanium diisopropoxybis(ethylacetoacetate) was added as a catalyst in an amount of 25% by weight (3% by weight in terms of Ti atom) in relation to the resin solid content, and then 3-aminopropyltriethoxysilane was added as an aminosilane coupling agent in an amount of 5% by weight in relation to the resin solid content, and thus a filling resin solution was obtained.

The resin solution and 100 parts by weight of the above-described porous ferrite particles were mixed under stirring at 60° C. under a reduced pressure of 6.7 kPa (about 50 mmHg), and thus the resin was made to penetrate into and fill in the voids of the porous ferrite particles while the toluene was being evaporated. The pressure inside the vessel was made to get back to normal pressure, the toluene was removed almost completely while the stirring was being continued under normal pressure, and then the thus treated porous ferrite particles were taken out of the interior of the filling apparatus and placed in a vessel. The vessel was placed in a hot air heating oven, and the porous ferrite particles were heat treated at 220° C. for 1.5 hours.

Then, the particles were cooled down to room temperature, and the ferrite particles in which the resin was cured were taken out, the aggregation of the particles was disintegrated with a vibration sieve of 200M in mesh opening, and the nonmagnetic fractions were removed with a magnetic separator. Successively, the coarse particles were removed, again with a vibration sieve, to yield a resin-filled ferrite particle.

Next, a solid acrylic resin (trade name: BR-73, manufactured by Mitsubishi Rayon Co., Ltd.) was prepared, and 20 parts by weight of the acrylic resin was mixed in 80 parts by weight of toluene and thus the acrylic resin was dissolved in toluene to prepare a resin solution. To the resin solution, carbon black (trade name: Mogul L, manufactured by Cabot Corp.) was added as a conductivity control agent in an amount of 3% by weight in relation to the acrylic resin to yield a coating resin solution.

In a universal mixing stirrer, the obtained resin-filled ferrite particles were placed, the above-described acrylic resin solution was added and the resin coating was performed by the dip-and-dry method. In this case, the amount of the acrylic resin was set at 2% by weight in relation to the weight of the ferrite particles after filling of the resin. After coating, the resin-filled ferrite particles were heated at 145° C. for 2 hours, the aggregation of the particles was disintegrated with a vibration sieve of 200M in mesh opening, and the nonmagnetic fractions were removed with a magnetic separator. Successively, the coarse particles were removed, again with a vibration sieve, to yield a resin-filled ferrite carrier whose surface was coated with a resin.

Example 2

A porous ferrite particle (ferrite carrier core material) was obtained in the same manner as in Example 1 except that in the sintering conditions, the sintering temperature was set at 1056° C. and the oxygen concentration was set at 1.0% by volume.

The porous ferrite particle was filled with a silicone resin and coated with an acrylic resin in the same manner as in Example 1 to yield a resin-filled ferrite carrier.

Example 3

A porous ferrite particle (ferrite carrier core material) was obtained in the same manner as in Example 1 except that in the sintering conditions, the sintering temperature was set at 1090° C. and the oxygen concentration was set at 2.0% by volume.

The porous ferrite particle was filled with a silicone resin and coated with an acrylic resin in the same manner as in Example 1 to yield a resin-filled ferrite carrier.

Example 4

A porous ferrite particle (ferrite carrier core material) was obtained in the same manner as in Example 1 except that in the sintering conditions, the oxygen concentration was set at 1.4% by volume.

The porous ferrite particle was filled with a silicone resin and coated with an acrylic resin in the same manner as in Example 1 to yield a resin-filled ferrite carrier.

Example 5

A porous ferrite particle (ferrite carrier core material) was obtained in the same manner as in Example 1 except that in the sintering conditions, the sintering temperature was set at 1085° C. and the oxygen concentration was set at 0% by volume.

The porous ferrite particle was filled with a silicone resin and coated with an acrylic resin in the same manner as in Example 1 to yield a resin-filled ferrite carrier.

Example 6

A porous ferrite particle (ferrite carrier core material) was obtained in the same manner as in Example 1 except that in the sintering conditions, the sintering temperature was set at 1048° C. and the oxygen concentration was set at 0.9% by volume.

The porous ferrite particle was filled with a silicone resin and coated with an acrylic resin in the same manner as in Example 1 to yield a resin-filled ferrite carrier.

Comparative Example 1

A porous ferrite particle (ferrite carrier core material) was obtained in the same manner as in Example 1 except that the wet pulverization time was set at 5 hours, the slurry particle size was set at 2.1 μm, and in the sintering conditions, the sintering temperature was set at 1065° C. and the oxygen concentration was set at 1.7% by volume.

The porous ferrite particle was filled with a silicone resin and coated with an acrylic resin in the same manner as in Example 1 to yield a resin-filled ferrite carrier.

Comparative Example 2

A porous ferrite particle (ferrite carrier core material) was obtained in the same manner as in Example 1 except that the calcination temperature was set at 1000° C., and in the sintering conditions, the sintering temperature was set at 1150° C. and the oxygen concentration was set at 0% by volume.

The porous ferrite particle was filled with a silicone resin and coated with an acrylic resin in the same manner as in Example 1 to yield a resin-filled ferrite carrier.

Comparative Example 3

A porous ferrite particle (ferrite carrier core material) was obtained in the same manner as in Example 1 except that in the sintering conditions, the oxygen concentration was set at 1.1% by volume, the sintering temperature was set at 1090° C., the sintering time was set at 3 hours, the temperature increase rate was set at 300° C./hr and the temperature decrease rate was set at 200° C./hr.

The porous ferrite particle was filled with a silicone resin and coated with an acrylic resin in the same manner as in Example 1 to yield a resin-filled ferrite carrier.

Table 1 shows the production conditions in Examples 1 to 6 and Comparative Examples 1 to 3, inclusive of the wet disintegration, the slurry particle size, the sintering conditions (temperature, oxygen concentration and sintering time) and the resin filling amount. Table 2 shows the properties (pore volume, peak pore size, pore size distribution, average compression strength and coefficient of variation of compression strength) of the obtained ferrite carrier core materials and the properties (average particle size, saturation magnetization, carrier strength, charge amount variation rate and apparent density) of the obtained ferrite carriers.

average compression strength and the coefficient of variation of compression strength fall within the intended ranges, respectively.

In contrast, in each of the ferrite carrier core materials of Comparative Examples 1 and 2, the average compression strength is poor. In the ferrite carrier core material of Comparative Example 3, the average compression strength falls within the intended range, but the coefficient of variation of the compression strength exhibits a large value.

As shown in Table 2, in each of the ferrite carriers shown in Examples 1 to 6, any of the average particle size, saturation magnetization, carrier strength, charge amount variation rate and apparent density falls within the intended range.

In contrast, Comparative Examples 1 to 3 each exhibit a higher value for the carrier strength and a lower value for the coefficient of variation of the charge amount as compared to Examples 1 to 6.

The ferrite carrier obtained by filling a resin in the resin-filled ferrite carrier core material for an electrophotographic developer according to the present invention is a resin-filled ferrite carrier, accordingly is low in specific gravity and is capable of achieving weight reduction, and hence is excellent in durability, is capable of achieving long operating life, is higher in strength as compared to magnetic powder-dispersed

TABLE 1

| | Production conditions | | | | | | |
|---|---|---|---|---|---|---|---|
| | | | Slurry | Sintering conditions | | | |
| | Calcination temperature (° C.) | Wet disintegration (Hr) | particle size $D_{50}$ (μm) | Temperature (° C.) | Oxygen concentration (% by volume) | Sintering time (Hr) | Resin filling amount (% by weight) |
| Example 1 | 1080 | 10 | 1.5 | 1071 | 1.1 | 5 | 5 |
| Example 2 | 1080 | 10 | 1.5 | 1056 | 1.0 | 5 | 5 |
| Example 3 | 1080 | 10 | 1.5 | 1090 | 2.0 | 5 | 5 |
| Example 4 | 1080 | 10 | 1.5 | 1071 | 1.4 | 5 | 5 |
| Example 5 | 1080 | 10 | 1.5 | 1085 | 0.0 | 5 | 5 |
| Example 6 | 1080 | 10 | 1.5 | 1048 | 0.9 | 5 | 5 |
| Comparative Example 1 | 1080 | 5 | 2.1 | 1065 | 1.7 | 5 | 5 |
| Comparative Example 2 | 1000 | 10 | 1.4 | 1150 | 0.0 | 5 | 5 |
| Comparative Example 3 | 1080 | 10 | 1.5 | 1090 | 1.1 | 3 | 5 |

TABLE 2

| | Properties of ferrite carrier core material | | | | | Properties of ferrite carrier | | | | |
|---|---|---|---|---|---|---|---|---|---|---|
| | Pore volume (ml/g) | Peak pore size (μm) | Pore size distribution dv | Average compression strength (mN) | Coefficient of variation of compression strength (%) | Volume average particle size $D_{50}$ (μm) | Saturation magnetization ($Am^2/kg$) | Carrier strength (%) | Charge amount variation rate (%) | Apparent density ($g/cm^3$) |
| Example 1 | 0.067 | 0.55 | 0.33 | 144 | 28 | 37.2 | 60 | 0.5 | 96 | 1.83 |
| Example 2 | 0.076 | 0.59 | 0.30 | 132 | 29 | 37.8 | 61 | 0.8 | 97 | 1.76 |
| Example 3 | 0.053 | 0.61 | 0.34 | 180 | 17 | 37.6 | 58 | 0.2 | 98 | 1.89 |
| Example 4 | 0.071 | 0.79 | 0.34 | 128 | 32 | 37.5 | 59 | 0.7 | 95 | 1.70 |
| Example 5 | 0.067 | 0.41 | 0.26 | 159 | 21 | 38.0 | 66 | 0.3 | 97 | 1.76 |
| Example 6 | 0.095 | 1.20 | 0.51 | 105 | 38 | 37.9 | 60 | 1.0 | 93 | 1.72 |
| Comparative Example 1 | 0.068 | 1.56 | 0.83 | 86 | 46 | 38.0 | 60 | 3.8 | 74 | 1.52 |
| Comparative Example 2 | 0.109 | 0.73 | 0.31 | 91 | 34 | 37.9 | 67 | 3.2 | 79 | 1.74 |
| Comparative Example 3 | 0.065 | 0.68 | 0.41 | 135 | 52 | 37.4 | 60 | 1.6 | 84 | 1.86 |

As can be seen from the results shown in Table 2, in each of the ferrite carrier core materials shown in Examples 1 to 6, the carriers, and is free from the occurrence of cracking, deformation and melting due to heat or impact. The above-described ferrite carrier has a high carrier strength, and is accordingly further improved in durability and has a stable charging property at the time of endurance printing.

Consequently, the resin-filled ferrite carrier core material and ferrite carrier for an electrophotographic developer according to the present invention can be widely used in the fields associated with machines such as full-color machines required to be high in image quality and high-speed machines required to be satisfactory in the reliability and durability in the image maintenance.

What is claimed is:

1. A resin-filled ferrite carrier core material for an electrophotographic developer, comprising a porous ferrite particle having an average compression strength of 100 mN or more and a coefficient of variation of the compression strength of 50% or less.

2. The resin-filled ferrite carrier core material for an electrophotographic developer according to claim 1, wherein the pore volume and the peak pore size of the porous ferrite particle are 0.04 to 0.10 ml/g and 0.3 to 1.5 μm, respectively, and the pore size variation dv represented by the following formula in the pore size distribution of the porous ferrite particle is 1.5 or less:

$$dv=|d_{84}-d_{16}|/2 \quad (1)$$

$d_{16}$: Pore size calculated from the pressure applied to mercury when the amount of the intruded mercury reaches 16% in relation to the total amount of the intruded mercury in the high pressure region, defined as 100%

$d_{84}$: Pore size calculated from the pressure applied to mercury when the amount of the intruded mercury reaches 84% in relation to the total amount of the intruded mercury in the high pressure region, defined as 100%.

3. A resin-filled ferrite carrier for an electrophotographic developer, wherein a resin is filled in the voids of the ferrite carrier core material according to claim 1, and 3 to 20 parts by weight of the resin is filled in relation to 100 parts by weight of the ferrite carrier core material.

4. The resin-filled ferrite carrier for an electrophotographic developer according to claim 3, wherein the surface of the ferrite carrier is coated with a resin.

5. The resin-filled ferrite carrier for an electrophotographic developer according to claim 4, wherein the volume average particle size is 20 to 50 μm, the saturation magnetization is 30 to 80 $Am^2/kg$ and the apparent density is 1.0 to 2.2 $g/cm^3$.

6. The resin-filled ferrite carrier for an electrophotographic developer according to claim 3, wherein the volume average particle size thereof is 20 to 50 μm, the saturation magnetization thereof is 30 to 80 $Am^2/kg$ and the apparent density thereof is 1.0 to 2.2 $g/cm^3$.

7. An electrophotographic developer comprising the resin-filled ferrite carrier according to claim 3 and a toner.

8. The electrophotographic developer according to claim 7, used as a refill developer.

9. The electrophotographic developer according to claim 1, wherein a resin is filled in the porous ferrite particle.

* * * * *